United States Patent [19]

Sternberg

[11] 4,165,101

[45] Aug. 21, 1979

[54] DUPLICATING POSTCARD FORM

[76] Inventor: Hans J. Sternberg, Box 3478, Baton Rouge, La. 70821

[21] Appl. No.: 866,064

[22] Filed: Dec. 30, 1977

[51] Int. Cl.[2] ..... B41L 1/16; B41L 1/36; B41M 5/22

[52] U.S. Cl. ..... 282/27.5; 427/150; 427/153; 427/261; 428/195; 428/307; 428/914

[58] Field of Search ..... 282/22 R, 27.5, 28 R, 282/25; 428/914, 307, 195; 427/261, 153, 150; 229/69

[56] References Cited

U.S. PATENT DOCUMENTS

| | | | |
|---|---|---|---|
| 2,550,466 | 4/1951 | Green | 427/152 X |
| 2,802,678 | 8/1957 | Bright | 282/22 R |
| 3,104,799 | 9/1963 | Steidinger | 229/69 |
| 3,981,523 | 9/1976 | Maalouf | 282/27.5 |
| 4,036,511 | 7/1977 | Maalouf | 282/27.5 |

*Primary Examiner*—Thomas J. Herbert, Jr.
*Attorney, Agent, or Firm*—Cushman, Darby & Cushman

[57] ABSTRACT

An improved duplicating form capable of making one or more copies of each side of an original on a single copy is provided by the present duplicating form which utilizes a first reproducing sheet such as a carbon paper or a pressure sensitive paper in combination with a second reproducing sheet composed of a pressure sensitive paper in the duplicating form wherein the first sheet reproduces information on one side of the original and thereafter a pressure sensitive paper is utilized to reproduce information or other script marked on the other side of the duplicating form.

6 Claims, 13 Drawing Figures

Fig. 9.
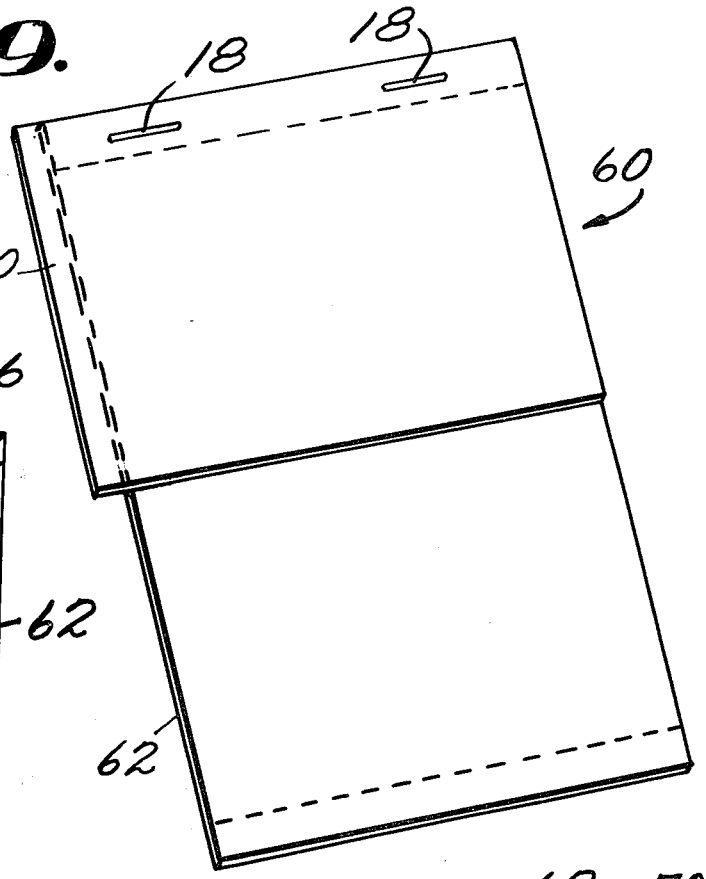
Fig. 10.
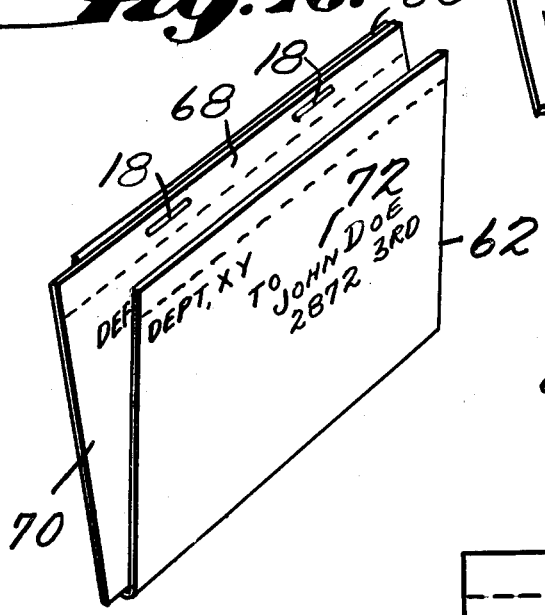
Fig. 11.
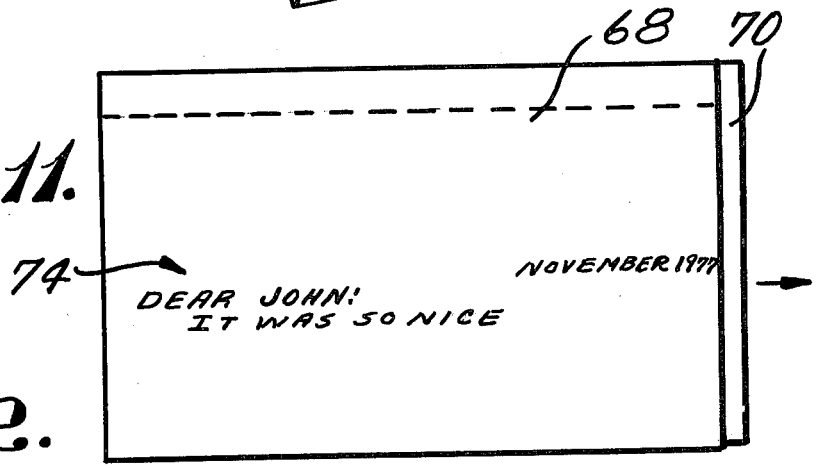
Fig. 12.
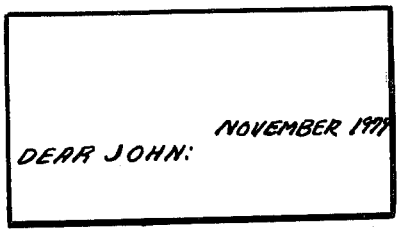
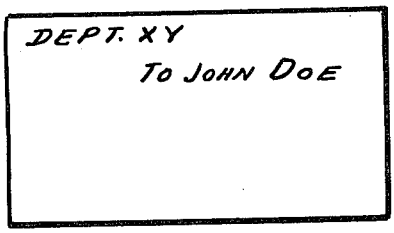
Fig. 13.

DUPLICATING POSTCARD FORM

BACKGROUND OF THE INVENTION

1. Field of the Invention

The invention relates to postcards and similar instruments for utilizing both sides of the document for recording information while simultaneously providing on a single copy sheet a duplicate bearing on both sides the same information as has been entered on both sides of the original.

2. Description of the Prior Art

There exists in the prior art a variety of duplicating forms which have been utilized in postcards, checkbooks, accounting sheets and other paper forms that employ a pressure sensitive paper or a carbon paper or some combination thereof in duplicating the information recorded on the original. The prior art duplicating devices include forms in which information placed on one side of an original sheet is duplicated either by means of a carbon or pressure sensitive paper on a retained office copy. The disadvantage of this type of duplicating device is that it is capable of recording information only on one side of the paper. In addition such duplicating forms are not suitable for use in the traditional sized single package postcard. Representatives of this class of postcards require either more parts, larger parts, or must furthermore be folded and joined prior to mailing and provide an odd sized copy for retention.

Another type of prior art duplicating device similar to the one described in U.S. Pat. No. 2,802,678 provides a duplicating form allowing the formation of a two-sided copy of a document by combining layers of carbon sheets, guard sheets and copy sheets as a means for recording information on one side of original and copy while preventing the simultaneous recording of information on the reverse side of the sheet. Duplicating forms of this type may be employed advantageously where the thickness of the original copies and guard sheets are maintained at a minimum. In addition, the guard sheets which prevent the duplication on both sides of the copy and original have the disadvantage of increasing the writing pressure necessary to record the informationn on one side of the instrument prior to the removal of the carbon and guard sheets and recording information on the other side of the document.

The problems involved with providing a single package duplicating form capable of clearly and accurately recording the same information on both sides of documents of the thickness and size of a standard postcard while providing a convenient sized file copy may in part be responsible for the proliferation of short letters and photocopies of documents having information recorded only on one side.

It has been a goal in the art of duplicating forms to provide a duplicating form with a reduced number of guard sheets necessary to prevent the recording of information on both sides of an instrument so that the heavier bond paper such as utilized in postcards may be used in duplicating forms. A further goal has been to provide a single package duplicating form that does not require bending or folding after the recording of information on both sides and which at the same time provides a clear two-sided copy of the original document.

SUMMARY OF THE INVENTION

The limitations and disadvantages of the prior art are obviated by the duplicating form of the present invention which provides a clear and accurate two-sided copy of documents having information recorded on both sides. In particular, the single package duplicating form of the invention utilizes a minimum number of sheets of paper in attaining the two-sided copy of two-sided documents in instances where it is desirable to have an original and/or a copy on paper having a bond of the thickness employed for postcards.

It will be understood that the term "original" as used herein and the appended claims refers to the document that is ordinarily sent or utilized as an original without limitation as to whether one or both sides of such document bears a copy of information previously typed on another sheet. The advantages of the invention are achieved by utilizing a first reproducing means such as a carbon paper sheet in combination with a second sheet composed of a pressure sensitive paper in a duplicating form wherein the first reproducing means is first used to obtain a duplicate copy of information recorded on one side of the original and thereafter utilizing a pressure sensitive paper to record information on the other side of the duplicating form.

In one embodiment of the invention a duplicating form is provided comprised of an original sheet which may be in the form of a postcard, a sheet of carbon paper and file copy sheet utilizing a pressure sensitive copy paper. The three sheets of paper in this embodiment of the invention are arranged in a single postcard package of a predetermined size such that the back side of the postcard or top original sheet is in direct contact with the non-marking side of the carbon sheet and the carbon marking side of the carbon paper is in contact with the pressure sensitive side of the pressure sensitive paper. In this embodiment the simultaneous recording of information on both sides of the original and file copy is accomplished by first recording information on the side of the original which will at the same time utilize the carbon sheet to record the same information on the file copy. The sheet of carbon paper not only records the information on one side of the file copy but at the same time prevents the formation of the mirror image of the same information on the reverse side of the original. Once this information is recorded on the original, which may take the form of an address or other such information, the carbon paper is then removed, and the single package form is then turned over and the material desired to be recorded is marked on the file copy sheet comprising the reverse side of the duplicating form. The recording of the information or message on the file copy simultaneously records the same information on the back side of the original paper through the use of pressure sensitive paper. In this embodiment of the invention one side of the original will display the information as recorded while the other side of the original will bear the information in the form of a copy of the information recorded on one side of the file copy sheet. In a similar manner the retained copy will have information recorded on one side in an original form while on the other side of the file copy will contain the information in the form of a copy.

In a further embodiment of the invention, an original bearing the information as recorded on both sides of the original and a file sheet copy bearing a copy on both sides of the same information as appearing on the original is provided. In this application of the invention, a single package is formed of a folded or layered postal card enclosing therein a similar arrangement of pressure sensitive paper and carbon paper which in this embodiment contains a tissue guard sheet. In this embodiment, material recorded on one side of the original is transferred to the copy by means of a carbon paper interposed between the original sheet and retained file copy sheet. The formation of a mirror image on the reverse side of the file copy sheet is prevented by the utilization of a tissue guard sheet interposed between the other side of the card and the file copy sheet. Once this information is recorded on the original and duplicated on one side of the file copy the carbon paper and the tissue guard are removed from the package and the original is turned over and the message is placed on the reverse side of the document which is simultaneously recorded on the reverse side of the file copy by the contact of the pressure sensitive ink. Once the information has been recorded on both sides of the original and simultaneously reproduced on both sides of the file copy, the file copy is then removed from the duplicating form.

A further embodiment of the invention provides a single package duplicating form wherein pressure sensitive paper is utilized alone to obtain a single file copy sheet which duplicates information entered on both sides of the original. In this embodiment a preselected section on one side of the file copy sheet and confronting original are treated with a system of pressure sensitive ink. In a similar manner the reverse side of the original has a different preselected section of the file copy sheet and confronting original treated with a pressure sensitive ink.

The advantages of the present invention include the ability to form crisp, clear two-sided copies of material recorded on both sides of an original where cards or other materials of heavy gauge are employed. The invention is particularly well adapted for use in postcards and other short forms by providing concise copies of the information recorded on the original.

Another aspect of the invention is the provision of a duplicating form providing copies of two-sided materials without the necessity of folding either the original for mailing for a similar folding or processing of the file copy sheet to provide a conveniently sized file copy.

Other and further objects and advantages of the present invention will become apparent to those skilled in the art from the specification in conjunction with the appended drawings which illustrate the application of the invention to short forms of communication such as postcards.

DESCRIPTION OF THE DRAWINGS

FIG. 9 is a frontal view of a further embodiment of the invention utilizing a no carbon copy message duplicating form with the front cover open to depict the single file copy sheet;

FIG. 10 is a side perspective view of the message unit of FIG. 9 illustrating the front cover;

FIG. 11 is a frontal view of the file copy sheet of the duplicating form of FIG. 10;

FIG. 12 is a frontal view of the reverse side of the duplicating form of FIG. 9; and FIG. 13 is a frontal view of the front side of the duplicating form of FIG. 9.

DETAILED DESCRIPTION OF THE INVENTION

Figure 1:
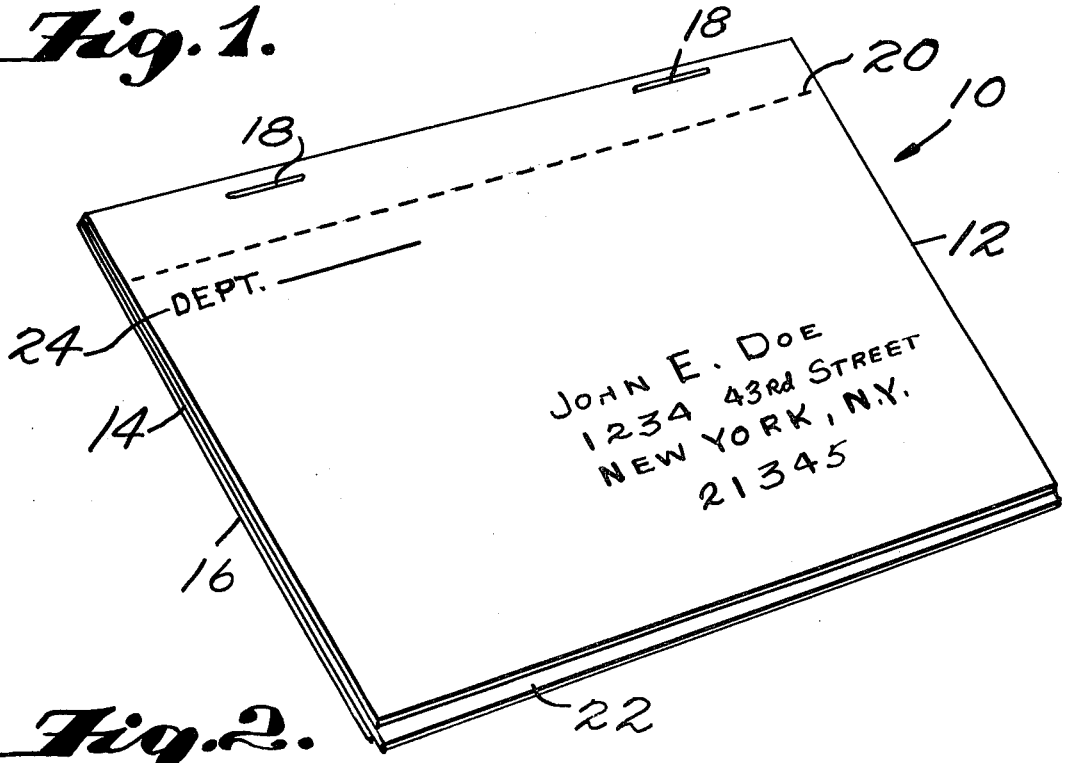
FIG. 1 is a perspective view of the front side of a postcard single package duplicating form constructed in accordance with the invention.
Figure 2:
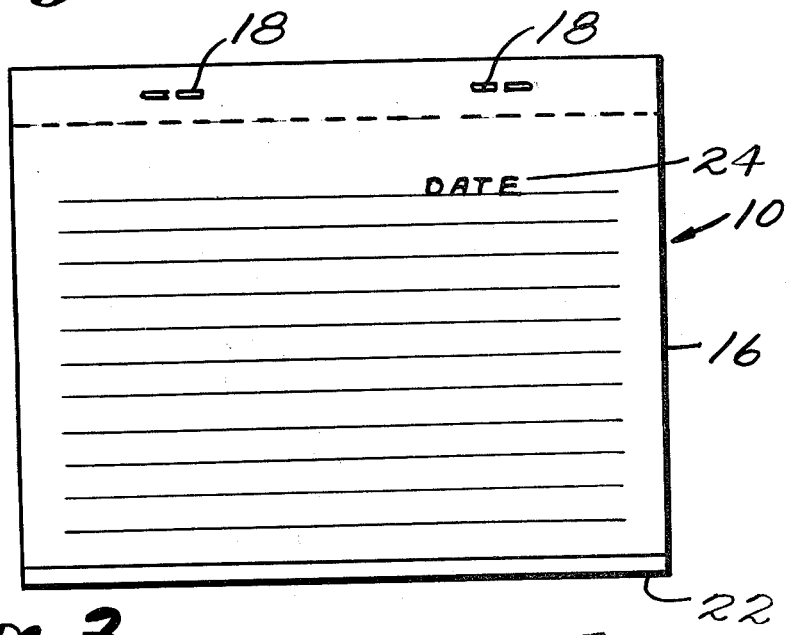
FIG. 2 is a frontal view of reverse side of a postcard as depicted in FIG. 1.

Referring now to FIGS. 1 and 2 of the drawing, reference character 10 denotes a postcard single package duplicating form utilizing one embodiment of the present invention. The postcard 10 includes an original card sheet 12, a carbon sheet 14 and a single file copy sheet 16. Sheets 12, 14 and 16 are bound together in a duplicating form by staples 18. The sheets 12, 14 and 16 each preferably contain perforations 20 to assist in the separation of the sheets in using the invention. In addition, carbon sheet 14 may contain a tab 22 or other means to assist in the separation of the carbon sheet after use. In the preferred embodiment of this application of the invention, the reverse side of sheet 12 is a sensitized receiving surface which when contacted with a pressure sensitive color reactant surface on the reverse side of sheet 16 after the removal of carbon sheet 14 results in the recording of information on the reverse side of sheet 12. It will be recognized that the pressure sensitive paper referred to may be of the "NCR" type as described in U.S. Pat. No. 2,550,466.

Figure 3:
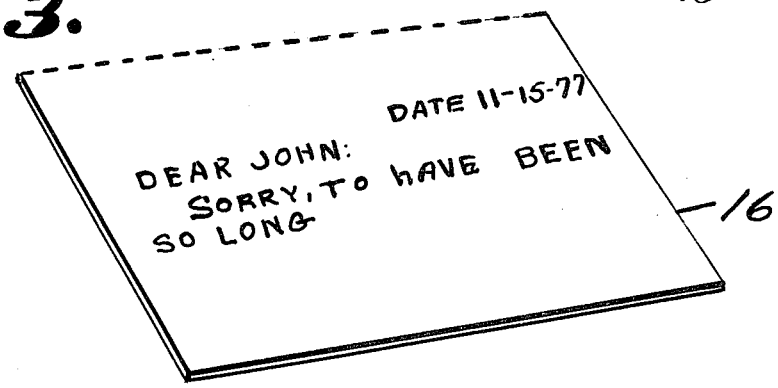
FIG. 3 is a perspective view of a completed message on the single file copy sheet of FIG. 2.

It will be recognized that in this embodiment the carbon sheet 14 simultaneously serves to reproduce the information placed upon the front surface of sheet 12 of the postcard on the reverse side of file copy sheet 16 while simultaneously acting as a barrier to prevent the pressure sensitive surfaces on the reverse sides of sheets 12 and 16 from contacting and thereby producing an undesirable mirror image. After the desired information is placed on the front side of sheet 12, carbon sheet 14 is removed with the assistance of perforations as heretofore discussed along with tab 22. Duplicating form 10 is then turned over and the message or information to be sent and duplicated is placed on the front side of sheet 16 which through the coaction of the pressure sensitive papers is duplicated on the reverse side of sheet 12. Once the desired information is recorded, sheet 12 may be separated and mailed and copy sheet 16 (FIG. 3) retained for office files.

As will be recognized from the drawing in conjunction with the foregoing description of the invention the postcard original sheet 12 as eventually sent, will contain the original printed information on the front side of original sheet 12 and will contain a copy of the original printed information on the reverse side of original sheet 12. Similarly the single file copy sheet 16 (FIG. 3) will bear the original message on the front side of copy sheet 16 and a copy of the original printed information on the reverse side of copy sheet 16. It will be recognized that the sheets and arrangement of the sheets may be modified in this embodiment to allow the original sheet 12 to contain the original message on the reverse side and a copy of the printed information on the front side. The duplicating form may also contain preprinted material 24 on sheets 12 and 16.

Postcards and message units produced in accordance with this embodiment of the invention are of particular utility in maintaining a copy having the same character of information as on the original postcard thereby reducing the necessity and volume of retained copies and papers ordinarily required to duplicate information contained on both sides of an original. The embodiment further serves to reduce the amount of time necessary to make copies of short forms of correspondence as in the nature of postcards.

Figure 4:
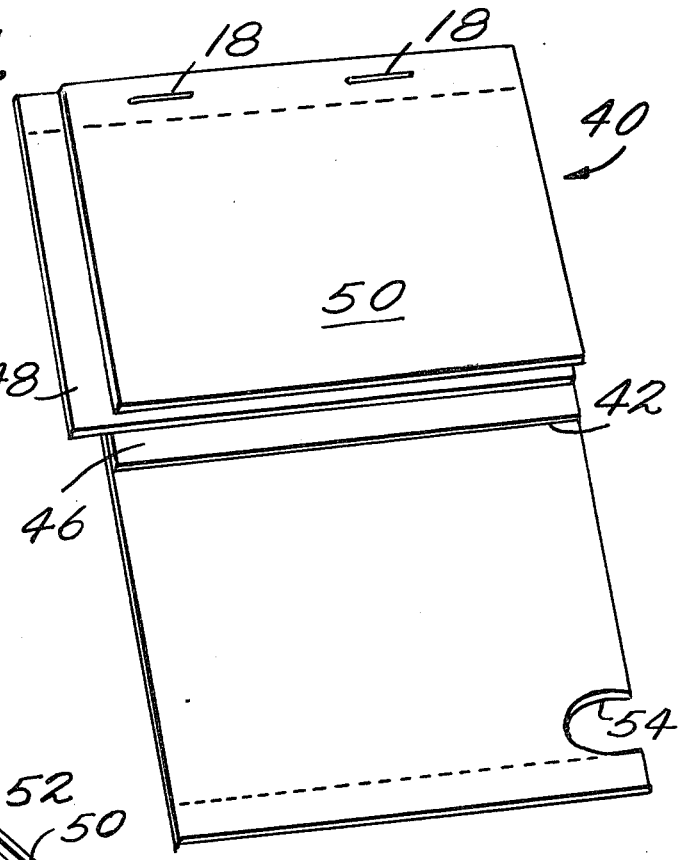
FIG. 4 is a frontal view of a second embodiment of the invention illustrating the single package duplicating form opened from the front to depict the guard tissue and the tab of the file copy sheet.
Figure 5:
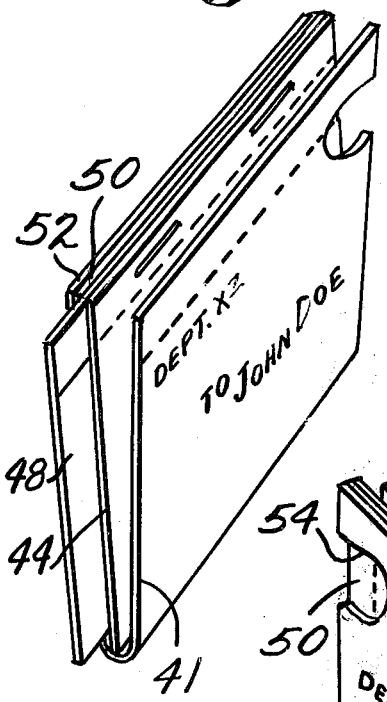
FIG. 5 is a side perspective view from the front side of the single package duplicating form as depicted in FIG. 4.
Figure 6:
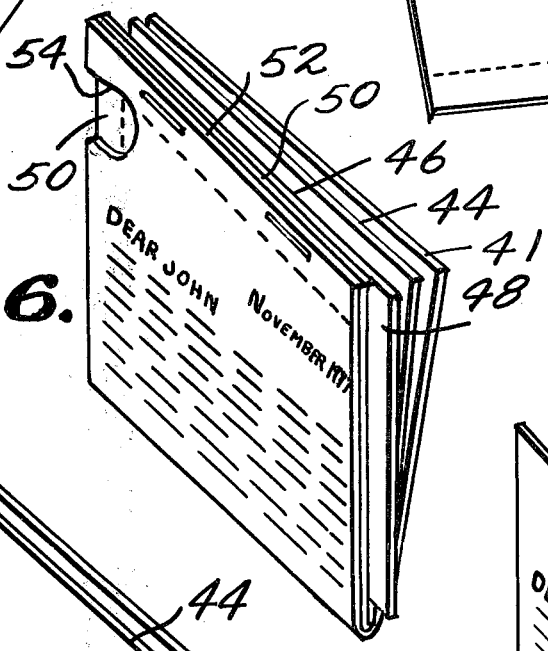
FIG. 6 is a side perspective view of the reverse side of the single package duplicating form as depicted in FIG. 4.

In a further embodiment of the invention, it is possible to have the original or mailed copy to bear the original information marked on both sides and a retained two-sided copy bearing a copy of the same information as is recorded on both sides of the original. Referring now to FIGS. 4, 5 and 6, the alternative embodiment illustrating the application of the invention to a duplicating form to provide an original bearing the original marking on both sides and a copy with a copy of the information recorded on the original is provided. As in the previously described embodiment a pressure sensitized sheet and a carbon sheet are utilized in the preparation of two-sided copies which in this embodiment utilize one additional guard sheet.

Figure 8:
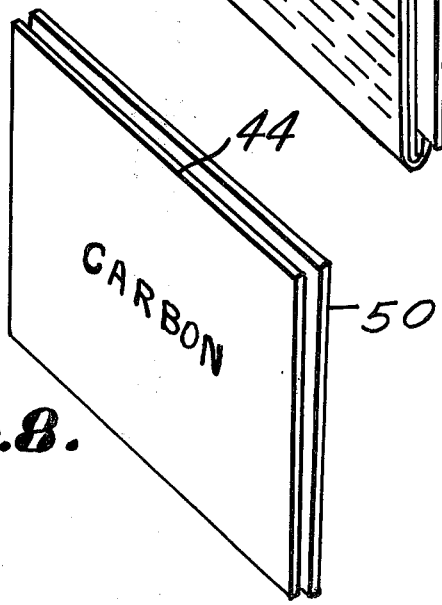
FIG. 8 depicts the removed carbon sheet and guard sheet utilized in the duplicating form of FIG. 4.

In this embodiment of the invention as illustrated in FIGS. 4, 5 and 6, the original of the duplicating form 40 may be a postal card with a fold 42 or of a single split sheet construction (not shown) with a split or separation between the layers to form a single package duplicating form. In either application of the invention to this embodiment the original sheet has a front side (FIGS. 5 & 6) 41 and a back side 52 to form an envelope enclosing a carbon sheet 44, a single file copy sheet 46 having a tab 48 disposed thereon to assist in its removal, and a guard tissue 50. The single package duplicating form 40 contains a cutout portion 54 through which on the back side 52 will protrude a portion of guard sheet 50 and on the front side 41 will protrude a portion of carbon sheet 44 to facilitate in removal of both the carbon sheet 44 and guard sheet 50 separately or as a unit (FIG. 8) after information is placed on the front side of duplicating form 40. Once sheets 44 and 50 have been removed the pressure sensitized sides on the reverse side of 52 and copy sheet 46 are in contact to record information recorded on the backside 52 of the duplicating form to form a copy utilizing the pressure sensitive paper as previously discussed.

Figure 7:
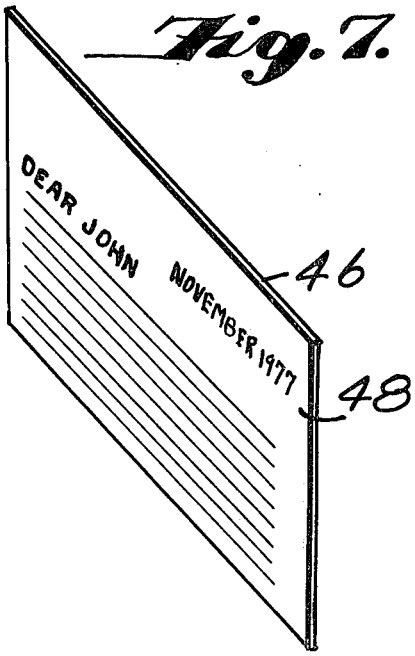
FIG. 7 depicts the retained single file copy sheet of FIG. 6.

Once the reverse side 54 of duplicating form 40 is completed tab 48 is utilized to remove the single file copy sheet 46 (FIG. 7) to provide a duplicate two-sided copy of the original card which then may be mailed or otherwise delivered in the manner of ordinary postal cards without the requirement of otherwise folding, joining or sealing the card.

Referring now to FIGS. 9 and 10, there is depicted a further embodiment of the invention which utilizes two component pressure sensitive papers alone to achieve the advantages of the present invention. Reference number 60 denotes a duplicating form with a fold or of a single construction with a split between layers to form a duplicating envelope similar to that discussed in reference to FIGS. 4, 5 and 6. In this embodiment a front side of an original sheet 62 and a reverse side of an original sheet 66 enclose a single file copy sheet 68 having a tab 70 thereon to assist in the removal of the single file copy sheet. In this embodiment the pressure sensitive sheets are arranged so that only a portion 72 on the reverse side of front side of original sheet 62 is treated with a pressure sensitive chemical to be in confronting relation to a pressure sensitive portion on file copy sheet 68. A second portion 74 (FIG. 11) is arranged on the reverse side of original sheet 66 in confronting relation to a pressure sensitive portion of the other side of file copy sheet 68. The first portion 72 and second portion 74 are arranged so that no overlapping occurs. One such arrangement possible for the purposes of illustration is to treat the top half of the reverse side of original sheet 62 and the top half of copy sheet 68 facing the reverse side of original sheet 62 and treat the bottom half of the reverse side of original sheet 66 and the bottom half of copy sheet 68 confronting the reverse side of sheet 66. In this embodiment all information placed on the top half of front side of original sheet 62 will be reproduced on the top half of single copy sheet 68 (FIG. 13) and when the duplicating form 60 is turned over and the message is written on the bottom half of original sheet 66 a copy of this information will appear on the reverse side of single copy sheet 68 (FIG. 12). It will be recognized by those skilled in the art that the same advantages may be achieved by the utilization of carbon paper in both instances or a combination of carbon paper and pressure sensitive chemicals to cover alternatively the top half and bottom portion of the respective sides of the message unit.

The invention has been illustrated and discussed with particular reference to the arrangement of carbon and pressure sensitive papers in postcards and other message units utilizing the novel aspects of the present invention. It will be recognized, however, by those skilled in the art that the arrangement of the pressure sensitive paper in relation to the carbon paper may be modified without departing from the spirit or scope of the present invention. It will be further appreciated that substitutions and modifications may be made in the present invention to suit the particular requirements of the duplicating form being utilized. Consequently these and other modifications and substitutions may be made within the spirit and scope of the invention as defined in the following claims.

What is claimed is:

1. A duplicating form for obtaining two-sided copying of information comprising:
   (a) a first post card sheet wherein one side of said first sheet is treated with a color developer of a two-component pressure sensitive chemical system;
   (b) a second sheet wherein one side of said second sheet is treated with a color former of a two-component pressure sensitive chemical system, and with said one side of said second sheet facing said one treated side of said first sheet; and
   (c) a carbon sheet removably disposed between said first sheet and said second sheet, said carbon sheet having an image-reproducing side facing said one side of said second sheet.

2. The duplicating form of claim 1 additionally comprising a guard sheet, said guard sheet being disposed between said treated side of said second sheet and said treated side of said first sheet.

3. The duplicating form of claim 2 wherein said sheets of said duplicating form are bound together in a single package.

4. The duplicating form of claim 3 wherein said first sheet contains means for removing said guard sheet and said carbon sheet.

5. The duplicating form of claim 4 wherein said guard sheet and said carbon sheet are removable as a unit by utilizing said means for removing said guard sheet and said carbon sheet.

6. The duplicating form of claim 5 wherein said first sheet forms an envelope enclosing said carbon sheet, said second sheet and said guard sheet.

* * * * *